US007367693B2

(12) United States Patent
Tsukamoto et al.

(10) Patent No.: US 7,367,693 B2
(45) Date of Patent: May 6, 2008

(54) VEHICULAR LAMP AND PROJECTION LENS FOR DECREASING AN AMOUNT OF BLOCKED LIGHT

(75) Inventors: Michio Tsukamoto, Shizuoka (JP); Hiroshi Kawashima, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 11/511,287

(22) Filed: Aug. 29, 2006

(65) Prior Publication Data

US 2007/0047248 A1 Mar. 1, 2007

(30) Foreign Application Priority Data

Sep. 1, 2005 (JP) ..... P.2005-253985

(51) Int. Cl.
*F21V 7/00* (2006.01)

(52) U.S. Cl. ..... 362/308; 362/351; 362/300; 359/668; 359/708; 359/720

(58) Field of Classification Search ..... 362/300, 362/307–308, 351, 538; 359/668, 720, 708
See application file for complete search history.

(56) References Cited

U.S. PATENT DOCUMENTS 4,339,178 A * 7/1982 Smith ..... 359/720
4,928,213 A * 5/1990 Nakata ..... 362/539
4,933,599 A * 6/1990 Fukuda ..... 313/478
5,070,432 A * 12/1991 Kitazumi et al. ..... 362/538
6,714,361 B2 * 3/2004 Miks et al. ..... 359/708
6,736,524 B2 * 5/2004 Albou ..... 362/228
2004/0080835 A1 * 4/2004 Chinniah ..... 359/708

FOREIGN PATENT DOCUMENTS

JP 2001-76510 A 3/2001

* cited by examiner

*Primary Examiner*—Jong-Suk (James) Lee
*Assistant Examiner*—Julie A Shallenberger
(74) *Attorney, Agent, or Firm*—Sughrue Mion, PLLC

(57) ABSTRACT

A vehicular lamp that decreases the amount of light blocked by the extension towards the inside of the vehicle and increases the diffused light radiated toward the outside of the vehicle. The vehicular lamp 100 has a projection lens 33, a light source 27, a reflector 29 having a reflecting surface 29*a* in which the light source 27 acts as an approximate focal point and light from this light source 27 is reflected toward the projection lens 33, a container-shaped body 21, and a cover 23 that along with the body 21 forms a light chamber. The cover 23 has a horizontal cross-section that is slanted with respect to an imaginary line 25 in the transverse direction of the vehicle, and the projection lens 33 has a rear side focal point f, the thickness of the lens 33 decreasing from the center portion toward the outer peripheral portions, and on the outer peripheral portions, a vehicular inside edge portion projects more toward the front side of the vehicle than the vehicular outside edge portion.

18 Claims, 12 Drawing Sheets

VEHICULAR LAMP AND PROJECTION LENS FOR DECREASING AN AMOUNT OF BLOCKED LIGHT

BACKGROUND OF THE INVENTION

1. Field of the Invention

The present invention relates to a vehicular lamp provided with a projector-type lamp unit.

2. Background Art

In the projector-type headlamp 200 shown in FIG. 11, for example, a light source 204*a* of a light source bulb 204 is disposed in proximity to a first focal point of a reflector 203 having a rotational ellipsoidal surface, and a bilaterally symmetrical projection lens 202 having a rear side focal point is disposed in proximity to a second focal point at which light from this light source 204*a* converges. In this type of conventional projector-type headlamp 200, the light emitted from the light source bulb 204 converges once at the second focal point, and subsequently the light that diffused in a radial fashion is projected in the radiation direction by the projection lens 202.

When using the reflector 203 having a rotational ellipsoidal surface, light reflected at the reflector 203 is condensed in proximity to the rear side focal point of the projection lens 202, and the light that is refracted and emitted by the projection lens 202 is projected forward in a condensed state as a substantially parallel light flux. Such a reflector 203 is used, for example, in a high beam lamp unit, and can radiate light a long distance. However, in this type of reflector 203 having a rotational ellipsoidal surface, because the light cannot diffuse sufficiently in the horizontal direction, the sideways visibility is relatively reduced.

A technique for enhancing the sideways visibility, as shown in FIG. 12, is a projector-type headlamp 300 that uses a reflector 303 and a bilaterally symmetrical projection lens 302, where the reflector 303 is provided with a reflecting surface having a cross-sectional profile on the optical axis Ax that is generally ellipsoidal in shape, and an eccentricity thereof is set so as to increase gradually from a vertical cross-section to a horizontal cross-section, that is, a vertical cross-section has a generally ellipsoidal profile and the horizontal cross-section has a free-form surface profile based on an ellipse. See, e.g., Japanese Patent Application Publication No. JP-A-2001-76510.

In the projector-type headlamp 300, in particular in the horizontal cross-section, because the reflector 303 is designed such that the light rays from the light source 304*a* of the light source bulb 304 are reflected forward beyond the rear side focal point of the projection lens 302 so that their distance from the optical axis increases, the light diffuses in the horizontal direction, and it is possible to enhance the sideways visibility.

However, when using the reflector 303 having a reflecting surface whose vertical cross-section has a generally ellipsoidal profile and whose horizontal cross section has a free-form surface profile based on an ellipse in order to increase the diffusion in the horizontal direction, it is not always possible to accommodate the sharp slant of a cover 305 along an external contour of a vehicle body. As shown in FIG. 12, a portion of the diffused light emitted from the light source 304*a* and radiated toward the inside of the vehicle may be blocked by the extension 306 or the like.

In order to prevent the diffused light from being blocked in this manner by the extension, narrowing the diffusion angle of the light in the transverse direction of the vehicle may be considered, but in a bilaterally symmetrical optical system, because the left and right diffusion angles are identical, there is a problem in that the diffusion angle toward the outside of the vehicle is reduced when the diffusion angle toward the inside of the vehicle is reduced. In such a structure, there is a concern that the nighttime sideways visibility will decrease and bring about a deterioration in safety. In addition, in a conventional bilaterally symmetrical lens, the light incident on the outer peripheral portions of the lens toward the inside of the vehicle is reflected by the lens emitting surface, and as a result, the light utilization rate decreases, and the diffused light that is radiated toward the outside of the vehicle decreases.

SUMMARY OF THE INVENTION

In consideration of the problems described above, at least one object of the present invention is to provide a vehicular lamp that decreases the amount of light blocked by the extension toward the inside the vehicle, increases the diffused light that is radiated toward the outside of the vehicle, and enhances the light utilization rate and safety.

This and other objects of the present invention are attained by a structure described below:

(1) A vehicular lamp having a projection lens, a light source, a reflector with a reflecting surface in which the light source acts as an approximate focal point and light from the light source is reflected toward the projection lens, a container-shaped body, and a cover that along with the body forms a light chamber, and in which the light emitted from the projection lens is projected forward along an optical axis, wherein the cover has a horizontal cross-section that is slanted with respect to an imaginary line in the transverse direction of the vehicle, and the projection lens has a rear side focal point, the thickness of the lens decreasing from a center portion toward outer peripheral portions, and on the outer peripheral portions, a vehicular inside edge portion projects more toward the front side of the vehicle than the vehicular outside edge portion.

(2) The vehicular lamp described in (1) wherein an area is formed in which, at a center portion of this projection lens, an incident surface and an emitting surface of the light from the light source are substantially orthogonal to the optical axis.

(3) The vehicular lamp described in (1) and (2) wherein an additional optical system is provided behind the vehicular inside edge portion.

(4) The vehicular lamp described in any one of (1) to (3) wherein the projection lens projects the light passing in proximity to the rear side focal point forward as a substantially parallel light flux.

(5) The vehicular lamp described in any one of (1) to (3) wherein the projection lens refracts the light incident on the vehicular outside edge portion side of the projection lens, without passing in proximity to the rear side focal point, such that the forward direction changes less than that of the light incident on the vehicular inside edge portion side.

The present invention is also directed to the projection lens itself, having the characteristics described herein.

According to the present invention, the cover has a horizontal cross-section that slants with respect to an imaginary line in the transverse direction of the vehicle and the projection lens has a rear side focal point, and at the same time, the thickness of the lens deceases from the center portion toward the outer peripheral portions, and on the outer peripheral portions, the vehicular inside edge portion projects more toward the front side of the vehicle than the vehicular outside edge portion, and thus, the projection lens has a bilaterally asymmetrical profile, and it is possible to change the lateral diffusion angle of the light distribution. Thereby, in a vehicular lamp having a sharp lateral slant, the amount of light blocked by the extension toward the inside of the vehicle is reduced, and it is possible to increase the diffused light that is radiated toward the outside of the vehicle. As a result, it is possible to obtain a vehicular lamp having a high efficiency and safety. In addition, because the projection lens has a bilaterally asymmetrical profile, the vehicular inside edge portion can be profiled so that complete reflection does not occur, and therefore, it is possible to increase the diffused light that is radiated toward the outside of the vehicle, and it is possible to realize a vehicular lamp having a high degree of efficiency and safety. Furthermore, although this type of operation is possible to some extent by changing the profile of the reflector, according to the present invention, it is possible to form a unique design by modifying the profile of the projection lens.

In addition, according to the present invention, because the projection lens has an area in the center portion in which the incident surface and the emitting surface of the light from the light source are substantially orthogonal to the optical axis of the lens, the light is projected without the upper end edge of the shade causing significant distortions, and it is possible to easily form a cut-off line having lateral asymmetries at the horizontal upper end edge of the light distribution pattern.

In addition, according to the present invention, because an additional optical system is provided behind the vehicular inside edge portion, if a dedicated light source, for example, is added as an additional optical system, it is possible to increase the amount of light that is radiated toward the sides of the road surface and to enhance the visibility. In addition, if, for example, a dedicated reflector is added as an additional optical system, it is possible to make light that would be absorbed by the inner wall of the light chamber incident on the projection lens, and it is possible to increase the light utilization rate of light from the light source.

DETAILED DESCRIPTION OF THE PREFERRED EMBODIMENTS

Below, preferred embodiments of the present invention will be described with reference to the drawings.

Figure 1:
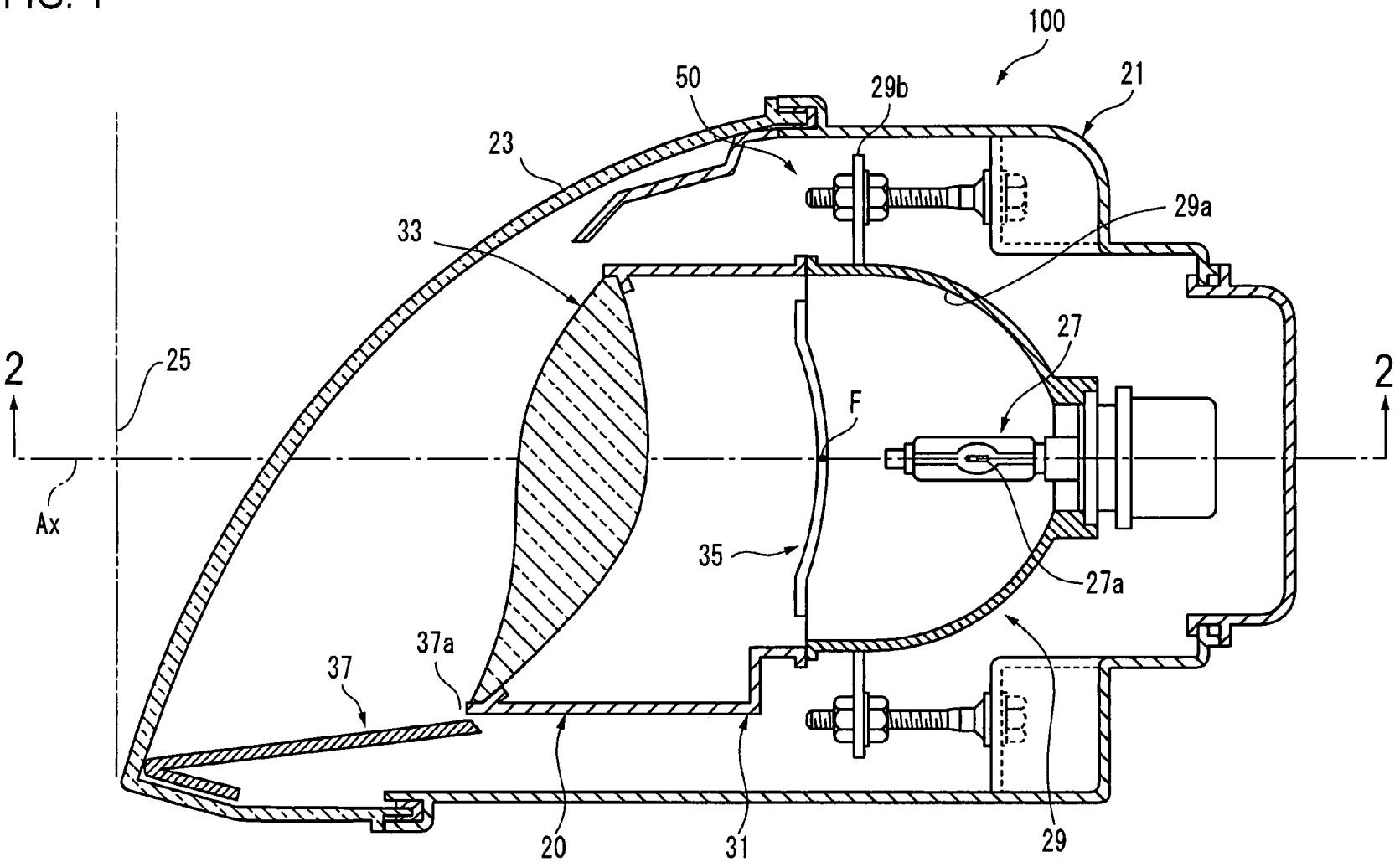
FIG. 1 is a horizontal cross-sectional view showing the vehicular lamp constructed according to an embodiment of the present invention.
Figure 2:
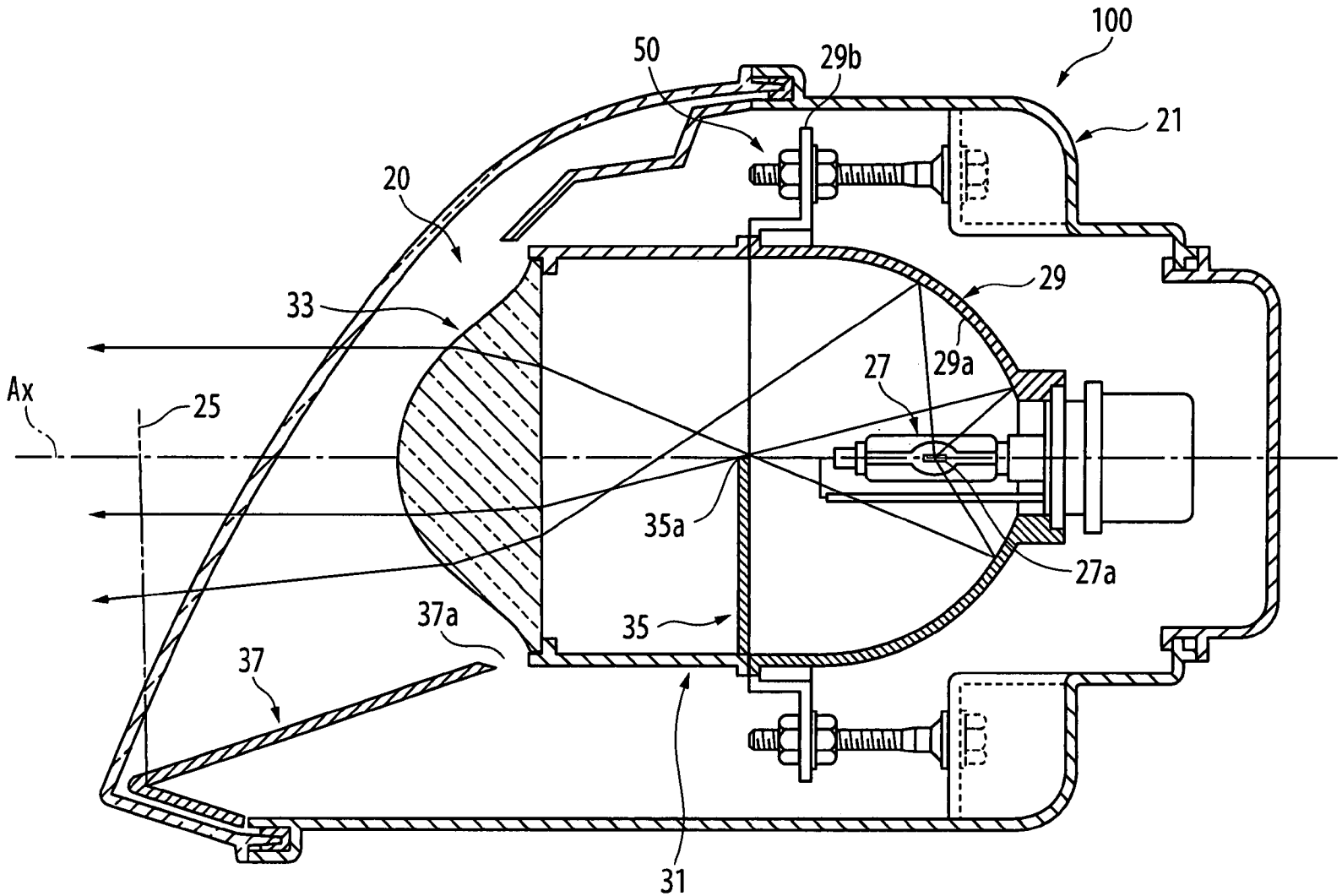
FIG. 2 is a vertical cross-sectional view along line 2-2 in FIG. 1.
Figure 3A:
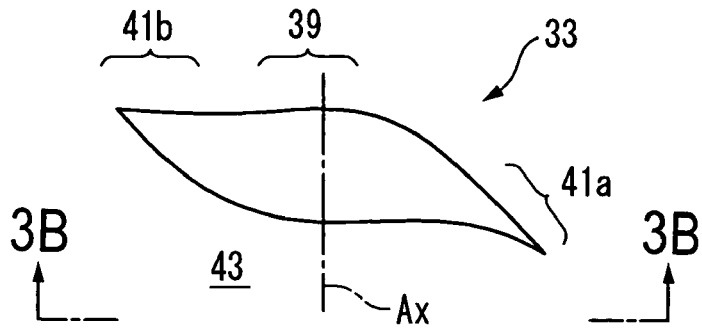
FIG. 3A is an explanatory drawing showing a plane view of the projection lens shown in FIG. 1.
Figure 3B:
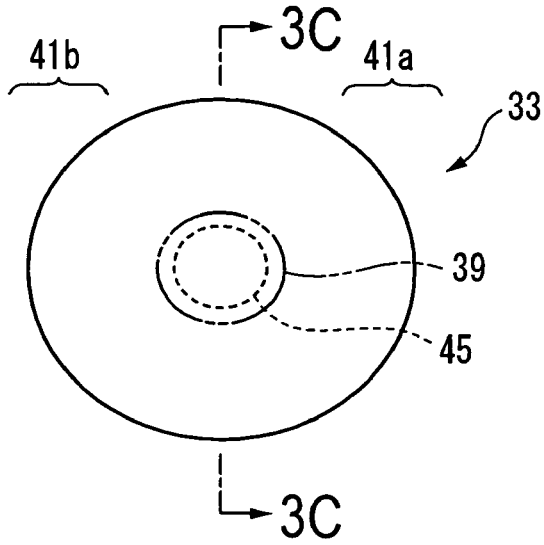
FIG. 3B is a cross-sectional plane along line 3B-3B in FIG. 3A.
Figure 3C:
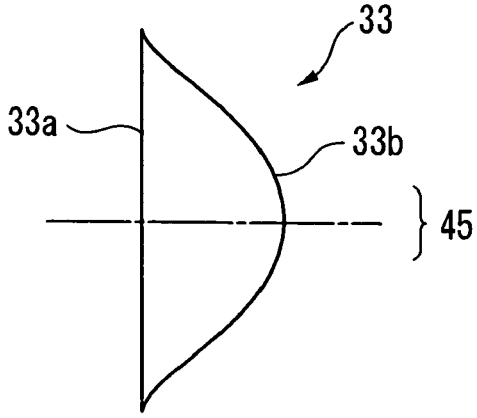
FIG. 3C is a cross-sectional plane along line 3C-3C in FIG. 3B.

FIG. 1 is a horizontal cross-sectional view showing the vehicular lamp according to an embodiment of the present invention. FIG. 2 is a vertical cross-sectional view along the line 2-2. FIG. 3A is an explanatory drawing showing a plane view of the projection lens shown in FIG. 1, a FIG. 3B is cross-sectional view along line 3B-3B, and FIG. 3C is a cross-sectional view along line 3C-3C.

As shown in these figures, this vehicular lamp 100 is a marker lamp disposed on the right front end portion of a vehicle, and a lamp unit 20 is accommodated in a lamp chamber that is formed by a lamp body 21 and a translucent, light-transmitting cover 23 that is attached to the front end opening portion thereof. In addition, in this vehicular lamp 100, a low beam light distribution pattern is formed by the lighting of the lamp unit 20.

The lamp unit 20 has an optical axis Ax that extends in a longitudinal direction of the vehicle, and is supported so as to be capable of being tilted in the vertical direction and horizontal direction by an aiming mechanism 50 in the lamp body 21. In addition, at the stage when the aiming adjustment using this aiming mechanism 50 has been completed, the optical axis Ax of the lamp unit 20 is structured so as to extend in a downward-oriented direction about 0.5 to 0.6° with respect to the longitudinal direction of the vehicle.

The translucent cover 23 curves rearward from the inner transverse side of the vehicle toward the outer transverse side of the vehicle along the vehicle body profile of the right side corner portion of the front end portion of the vehicle, and is formed so as to curve rearward from the lower end edge to the upper end edge. That is, the horizontal cross-sectional surface of the translucent cover 23 is slanted with respect to the imaginary line 25 in the transverse direction of the vehicle. The surface of this translucent cover 23 may also be slanted with respect to the imaginary line 25 so as to form a flat surface, or as shown in FIG. 1, may be slanted with respect to the imaginary line 25 so as to form a curved surface.

Next, the structures of each of the lamp units 20 will be explained.

The lamp unit 20 is a projector-type lamp unit, and is provided with a light source bulb 27, a reflector 29, a lens holder 31, a projection lens 33, a shade 35, and an extension 37.

The projection lens 33 has a rear side focal point F, and as shown in FIG. 3A, the thickness thereof decreases from the center portion 39 toward the outer peripheral portions 41, and on the outer peripheral portions 41, the vehicular inside edge portion 41*a* projects more toward the vehicular front side 43 than the vehicular outside edge portion 41*b*. In addition, at the center portion 39, an incident surface 33*a* and an emitting surface 33*b* for light from the light source has an area 45 that is substantially orthogonal to the optical axis Ax. The projection lens 33 is characterized in that this area 45 of the center portion 39 makes the light from the rear side focal point F become a parallel light flux. In addition, the image on the focal plane on the rear side focal point F is inverted and projected forward.

Because the projection lens 33 has an area 45 that is substantially orthogonal to the optical axis Ax of the lens at the center portion 39, the light is projected without the upper end edge 35*a* of the shade 35 causing significant distortions, and it is possible to form a cut-off line CL having lateral asymmetries (elbow point E) of the light distribution pattern at the horizontal upper end edge easily. See FIG. 9 described in more detail below.

In addition, the incident surface 33*a* and the emitting surface 33*b* at the center portion 39 of the projection lens 33 form continuous and bilaterally asymmetrical surfaces toward the vehicular inside edge portion 41*a* and the vehicular outside edge portion 41*b*. Therefore, the projection lens 33 has a diffusion portion with different diffusion angles at the left and right vehicular inside edge portion 41*a* and the vehicular outside edge portion 41*b* that surround the center portion 39. Furthermore, because the projection lens 33 has such a bilaterally asymmetrical profile, complete reflection does not occur at the vehicular inside edge portion 41*a*, as will be described below.

At the upper and lower portions that enclose the projection lens 33, a stepped lens holder 31 is formed facing forward from the front end opening of the reflector. The lens holder 31 is fastened to and supported by the reflector 29 at the back end portion thereof, and the projection lens 33 is fastened to and supported at the front end portion thereof.

The light source bulb 27 is, for example, a discharge bulb such as a metal halide bulb in which the discharging light source portion serves as the light source 27*a*, and this light source 27*a* is structured as a line segment light source that extends in an axial direction through the bulb center. In addition, this light source bulb 27 is inserted and fastened from the rear side at the back end opening portion of the reflector 29 so that this light source 27*a* is disposed on the optical axis Ax farther back than the rear side focal point F of the projection lens 33.

The reflector 29 has a reflecting surface 29*a* that reflects the light forward from the light source 27*a* along the optical axis Ax. This reflecting surface 29*a* has a generally ellipsoidal cross-sectional profile, and the eccentricity is set so as to increase gradually from a vertical cross-section to a horizontal cross-section. In addition, the light from the light source 27*a* that has been reflected by the reflecting surface 29*a* is substantially converged in proximity to the rear side focal point F within a vertical cross-section, and at the same time, within a horizontal cross-section, the convergence position of the light is moved significantly forward. This reflector 29 is supported on the aiming bracket 29*b* by the lamp body 21 via the aiming mechanism 50.

Figure 9:
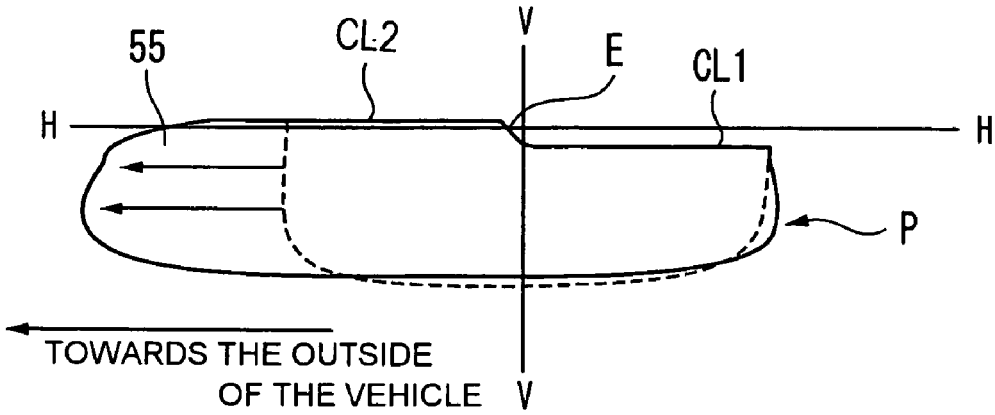
FIG. 9 is a drawing showing the light distribution pattern from the vehicular lamp provided on the left side of the vehicle.

The shade 35 is fastened to and supported by the lens holder 31 so as to be positioned in the generally lower half in the inner space of the lens holder 31. This shade 35 is formed such that the upper end edge 35*a* thereof passes through the rear side focal point F of the projection lens 33, and a portion of the reflected light that is radiated from the reflecting surface 29*a* of the reflector 29 is blocked. Most of the upwardly directed light that is emitted forward from the projection lens 33 is removed. Thereby, a cut-off line CL, shown in FIG. 9, is formed that has an elbow point E at the upper end edge of the light distribution pattern.

In addition, inside the light chamber described above, an extension 37 is provided along the translucent cover 23. An opening portion 37*a* that surrounds each of the lamp units 20 in proximity to the front end portion is formed at this extension 37.

Figure 4:
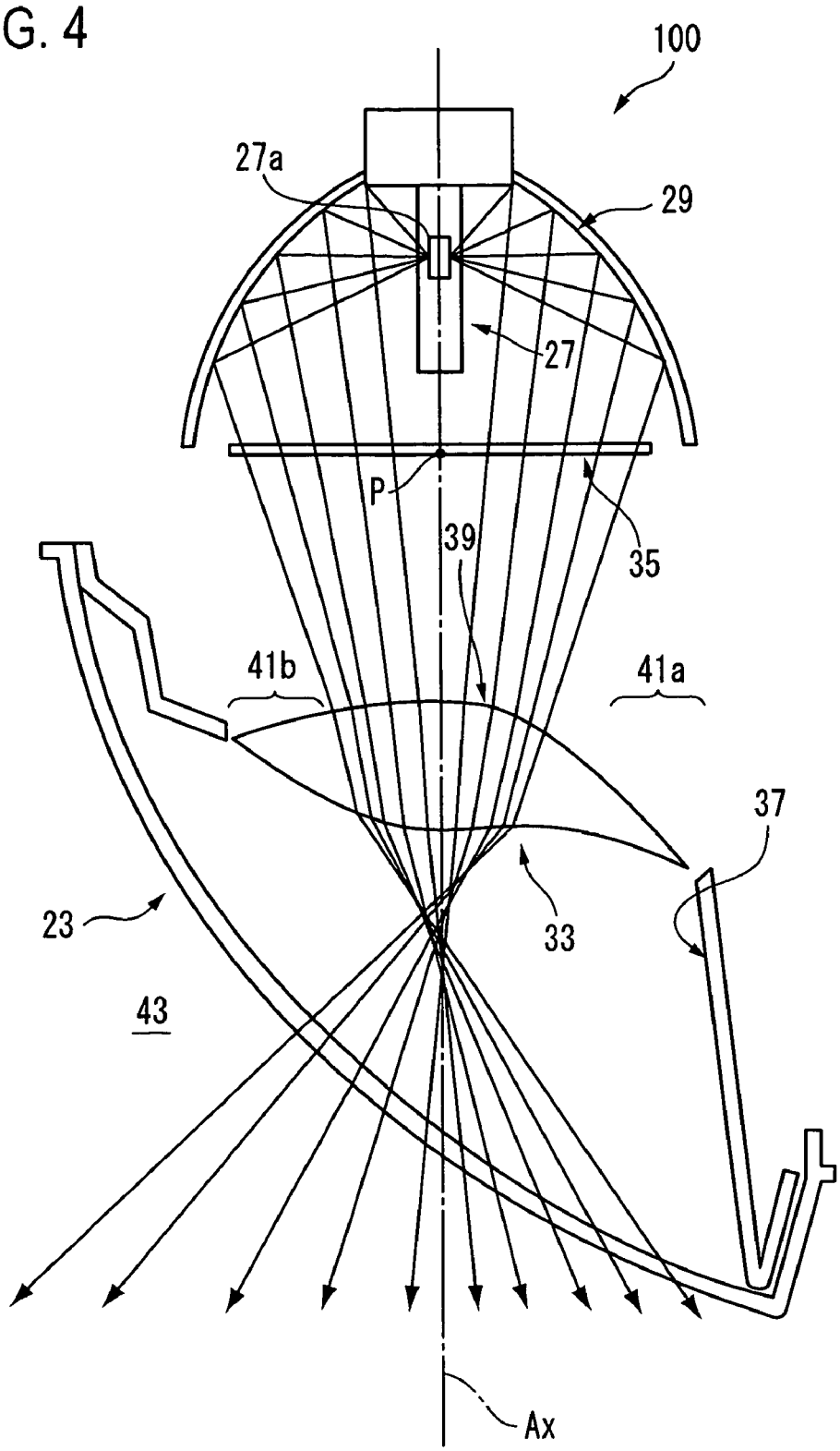
FIG. 4 is a drawing for explaining the operation of the vehicular lamp shown in FIG. 1.
Figure 5:
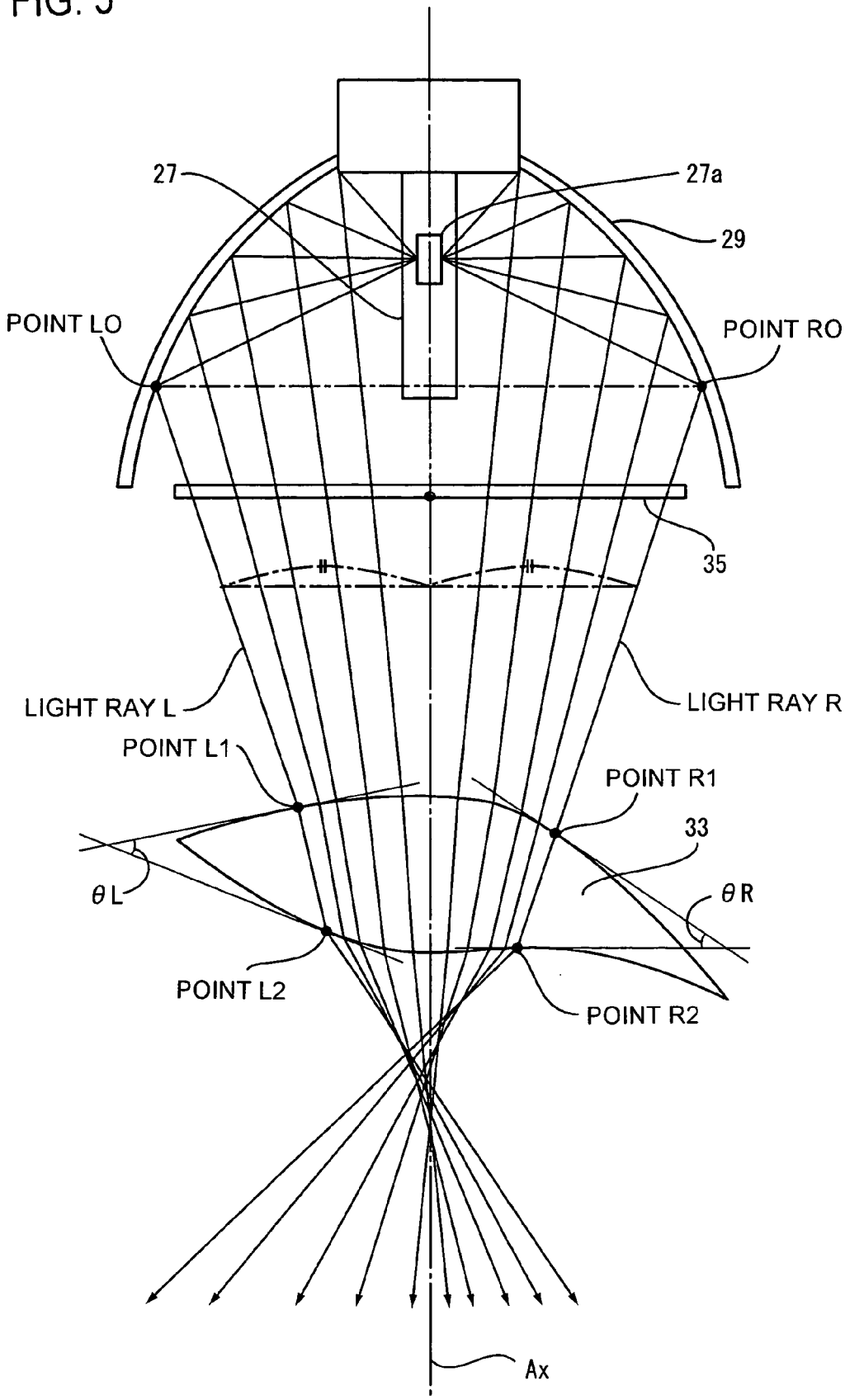
FIG. 5 is an enlarged view for explaining the operation of the vehicular lamp shown in FIG. 1.

FIGS. 4 and 5 are drawings for explaining the operation of the vehicular lamp shown in FIG. 1.

In the vehicular lamp 100, the thickness of the projection lens 33 decreases from the center portion 39 to the outer peripheral portions 41, and on the outer peripheral portions 41, the vehicular inside edge portion 41*a* projects more toward the vehicular front side 43 than the vehicular outside edge portion 41*b*, and the lateral diffusion angle of the light distribution becomes small on the vehicular inside edge portion 41*a* side and becomes large on the vehicular outside edge portion 41*b* side. In the present embodiment, the light incident on the vehicular outside edge portion 41*b* of the projection lens 33 has a smaller refraction range than the light incident on the vehicular inside edge portion 41*a* of the projection lens 33. Therefore, even in the case that the slant of the translucent cover 23 is sharp, the amount of light blocked by the extension 37 toward the inside of the vehicle is decreased, and it is possible to increase the sideways visibility by significantly deflecting the light toward the outside of the vehicle.

Specifically, FIG. 5 shows the case where light is incident on point LO of the reflector 29 after being emitted from the light source 27*a* and light is incident on point RO, which is present at a line-symmetrical position with respect to the point LO and the optical axis Ax. The light rays that are incident at each of the points LO and RO are reflected by the reflector 29, and propagated toward the projection lens 33 while respectively defining a line-symmetrical light path with respect to the optical axis Ax.

Then the respective light rays are incident on the projection lens 33 at points L1 and R1 on the projection lens 33, and propagate through the projection lens 33 while being refracted. The light rays are emitted from the projection lens 33 while being refracted at points L2 and R2 on the projection lens 33. Here, the projection lens 33 is structured so as to satisfy the relation $\theta L<\theta R$, when comparing the apex angle $\theta L$ defined by each of the tangent lines at points L1 and L2 and the apex angle $\theta R$ defined by each of the tangent lines at points R1 and R2. The apex angles $\theta L$ and $\theta R$ indicate the diffraction range of the light that is incident on the projection lens 33, and a larger apex angle significantly redirects the light in the forward direction. In this manner, when using the bilaterally symmetrical reflector 29, the projection lens 33 used in the present embodiment refracts the light that is incident on the vehicular outside edge portion 41*b* side so as to be redirected less in the forward direction than the light that is incident on the vehicular inside edge portion 41*a* side. Therefore, even when the slant of the translucent cover 23 is sharp, the light is not significantly over-deflected and blocked by the extension 37. Thus, it is possible to reduce the amount of light that is blocked by the extension 37 toward the inside of the vehicle. In addition, the light is significantly deflected toward the outside of the vehicle, and the sideways visibility can be enhanced.

Figure 6:
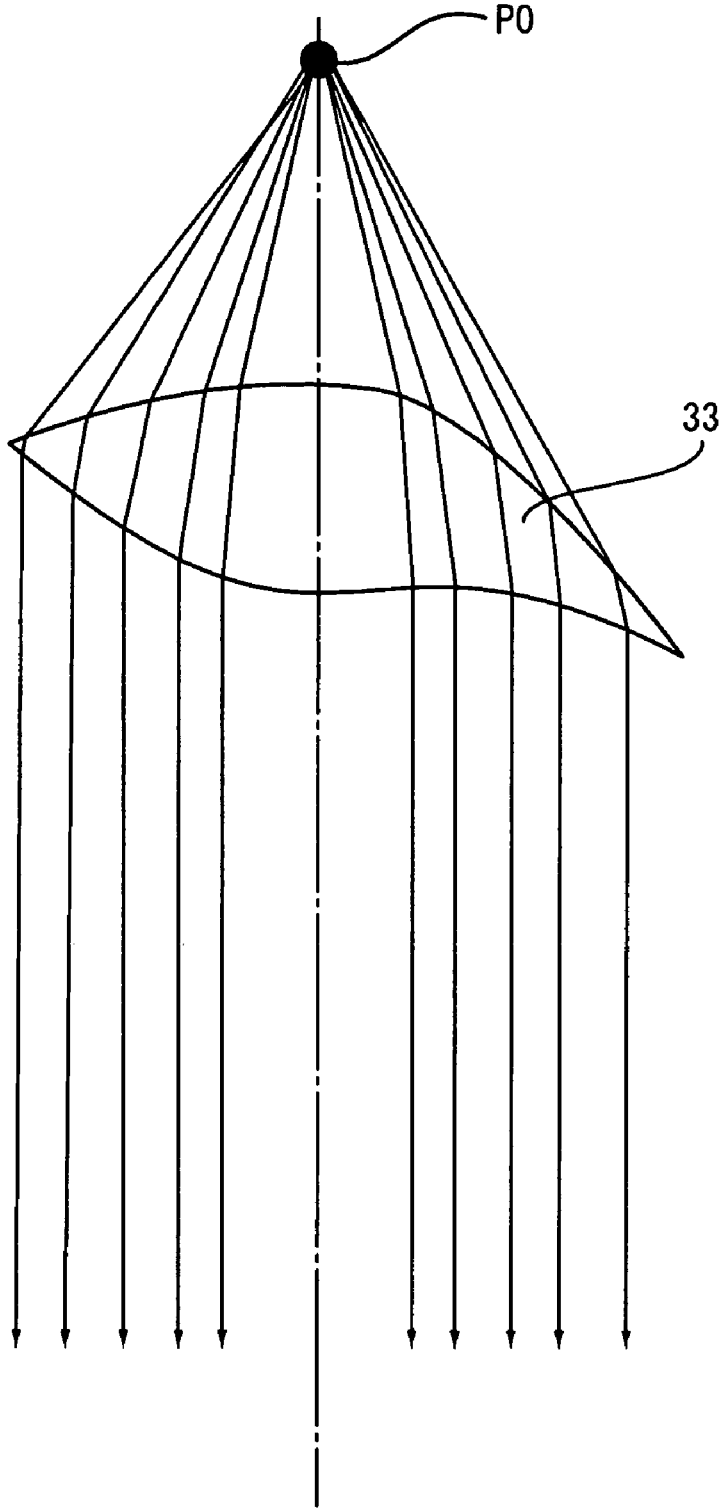
FIG. 6 is a drawing showing the operation of the projection lens.

Note that as shown in FIG. 6, the projection lens 33 has a rear side focal point PO, and like the normal bilaterally symmetrical convex lens, the incident surface and the emitting surface are structured such that the light that passes through the rear side focal point PO is projected forward as a parallel light flux. Therefore, when using a reflector that condenses the light at the rear side focal point PO, the projection lens 33 is structured so that the parallel light flux radiates forward.

Figure 7B:
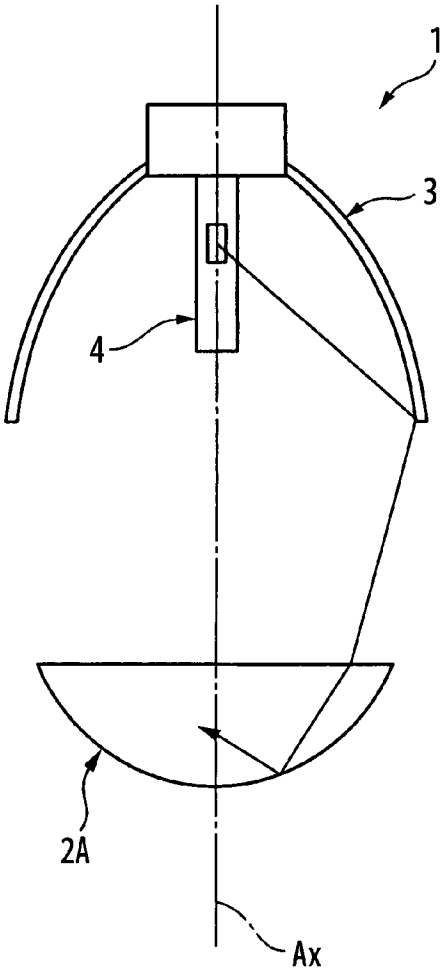
FIGS. 7A and 7B are explanatory drawings showing the operational differences produced by the different structures of the present invention and the conventional device.
Figure 7A:
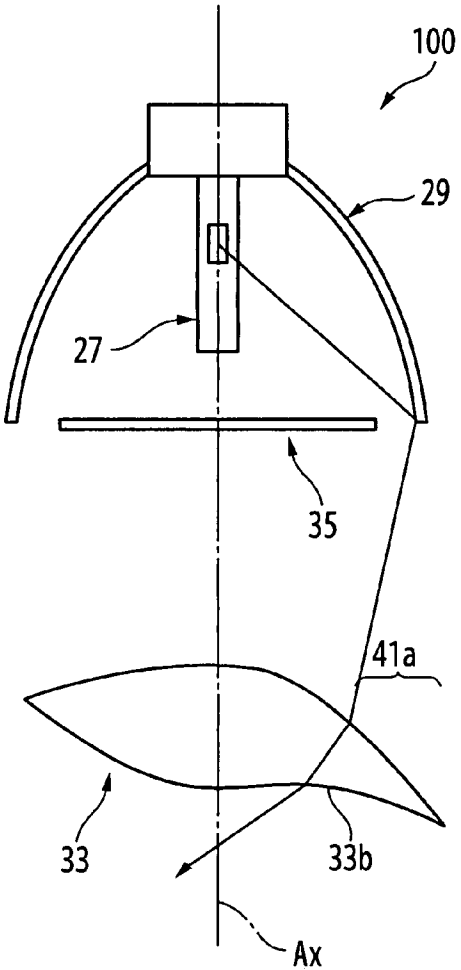

FIGS. 7A and 7B are explanatory drawings showing the operational differences produced by the different structures of the present invention and the conventional device.

In addition, because the projection lens 33 has a bilaterally asymmetrical profile, the vehicular inside edge portion 41*a* of the projection lens 33 can be profiled so that complete reflection does not occur. The light that is completely reflected due to the bilaterally symmetrical lens 2A in the conventional marker lamp 1, as shown in FIG. 7B, can be emitted from the emitting surface 33*b*, as shown in FIG. 7A.

Figure 8B:
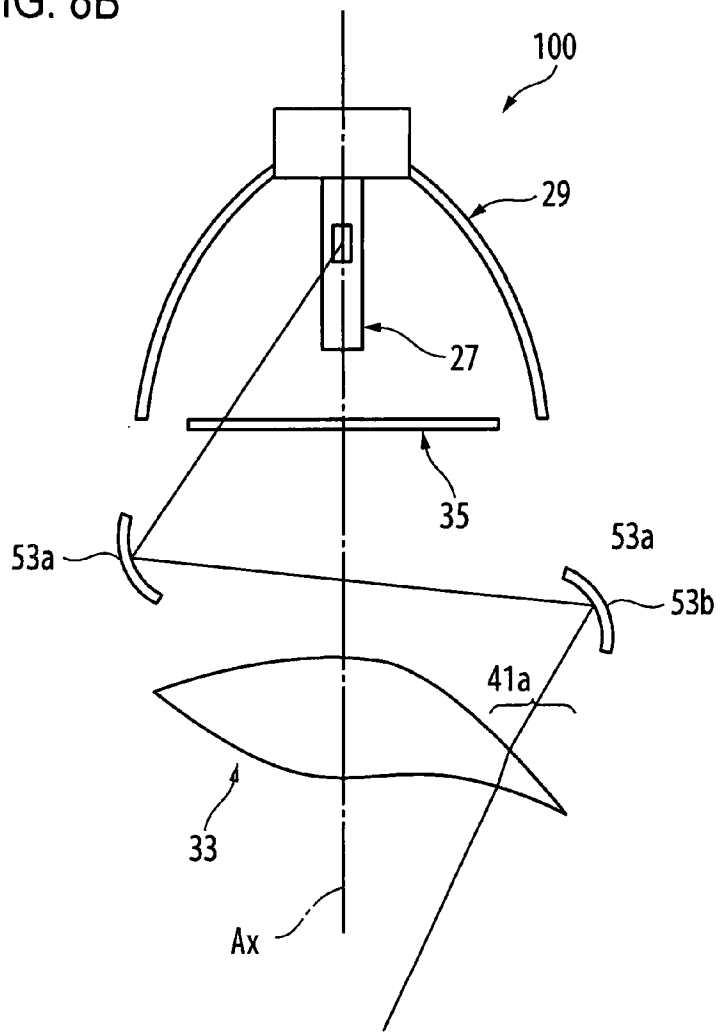
FIGS. 8A and 8B are explanatory drawings showing examples of a structure in which an additional optical system is provided.
Figure 8A:
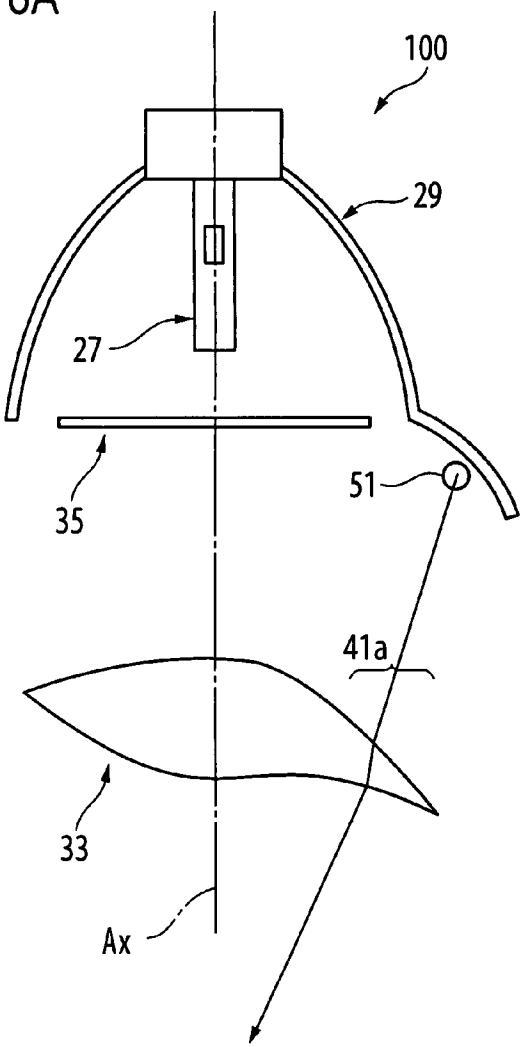

FIGS. 8A and 8B are explanatory drawings showing examples of the structure in which an additional optical system is provided.

Furthermore, the vehicular lamp 100 is preferably provided with an additional optical system at the back of the vehicular inside edge portion 41*a*. A dedicated light source 51, as shown in FIG. 8A, or dedicated reflectors 53*a* and 53*b*, as shown in FIG. 8B, can be used as the additional optical system, If, for example, a dedicated light source 51 is used, it is possible to increase the amount of light that is radiated toward the side of the road surface and it is possible to enhance the visibility. If, for example, the dedicated reflectors 53*a* and 53*b* are added as an additional optical system, it is possible to make the light that would be absorbed in the inner wall of the lamp chamber incident on the projection lens 33, and it is possible to improve the light utilization rate of the light from the light source bulb 27.

FIG. 9 is a drawing showing the light distribution pattern from the vehicular lamp provided on left side of the vehicle.

The light distribution pattern P is formed by radiated light that radiates from the lamp unit 20, but in this situation, this light distribution pattern P is formed by the image of the light source 27*a*, which is formed on the rear side focal point plane of the projection lens 33 due to the light that is reflected from the reflecting surface 29*a* of the reflector 29, projecting as an inverted projection image onto an imaginary vertical screen by the projection lens 33, and the cut-off lines CL1 and CL2 thereof are formed as an inverted projection image of the upper end edge 35*a* of the shade 35.

The light distribution pattern P is the low-beam distribution pattern for left side distribution, and the cut-off lines CL1 and CL2 are present in a stepped fashion to the left and the right at the upper end edge thereof. These cut-off lines CL1 and CL2 extend in a horizontal direction in a stepped fashion to the left and the right, where the line V-V, which passes in a vertical direction through the vanishing point H-V in the lamp forward direction, serves as an intersection therebetween. The portion of the opposite lane side on the right side of the line V-V forms the lower step cut-off line CL1, and side portion of the lane in which the driver's vehicle is travelling on the left of the line V-V forms the upper-step cut-off line CL2, which rises upward at the elbow point E from the lower step cut-off line CL1.

In addition, the light that passes through the vehicular outside edge portion 41*b* of the projection lens 33 forms a diffusion area 55 that expands toward the outside of the vehicle. The light distribution pattern P, which is formed by the light that is radiated from the lamp unit 20, is formed as a composite light distribution pattern that includes this diffusion area 55.

Therefore, according to the vehicular lamp 100 constructed according to the present embodiment, the thickness of the projection lens 33 decreases from the center portion 39 toward the outer peripheral portions 41, and on the outer peripheral portions 41, the vehicular inside edge portion 41*a* projects more toward the vehicular front side 43 than the vehicular outside edge portion 41*b*. Thus, the projection lens 33 has a bilaterally asymmetrical profile, and it is possible to change the lateral diffusion angle of the light distribution. Thus, even in a vehicular lamp 100 having a sharp lateral slant, the amount of light that is blocked by the extension 37 toward the inside of the vehicle is reduced, and it is possible to increase the diffused light that is radiated toward the outside of the vehicle. As a result, a vehicular lamp 100 having a high degree of efficiency and safety can be obtained.

In addition, because the projection lens 33 has a bilaterally asymmetrical profile, the vehicle inside edge portion 41*a* of the projection lens 33 can be profiled so that complete reflection does not occur, and therefore, it is possible to increase the diffused light that is radiated toward the outside of the vehicle, and it is possible to realize a vehicular lamp having a high degree of efficiency and safety. Furthermore, although this type of operation is possible to some extent by changing the profile of the reflector, according to the present invention, by changing the profile of the projection lens 33, it is possible to form a unique design.

EXAMPLE

Next, the results of a simulation of the light distribution pattern in a vehicular lamp having the same structure as the embodiment described above will be explained by way of an example.

Figure 10:
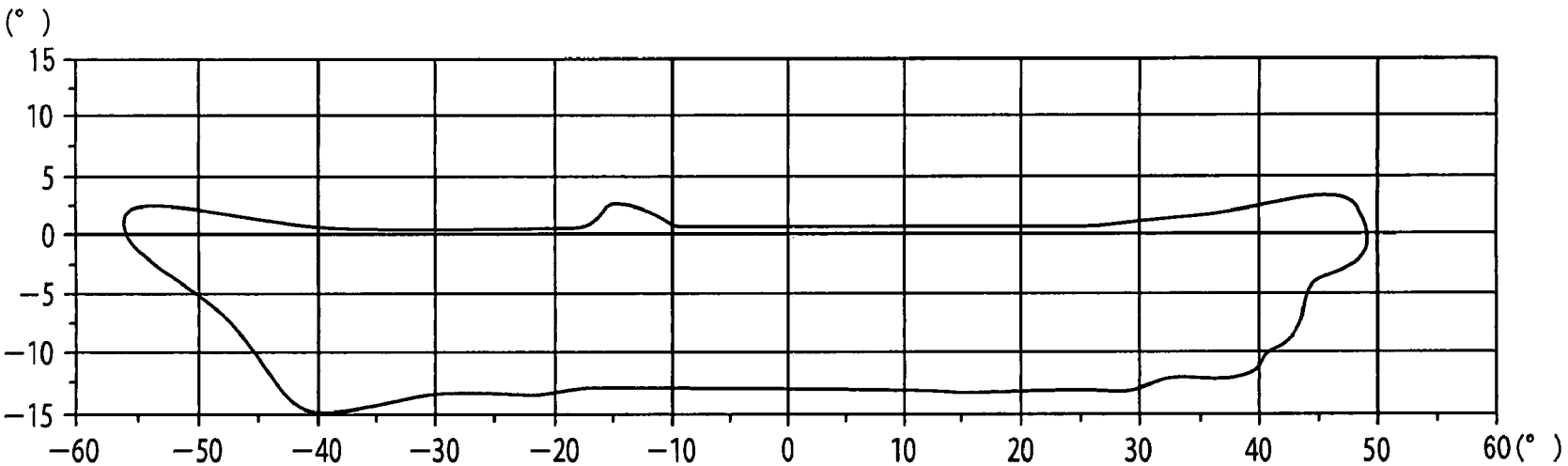
FIG. 10 is a drawing of a light distribution simulation according to an example.
Figure 11:
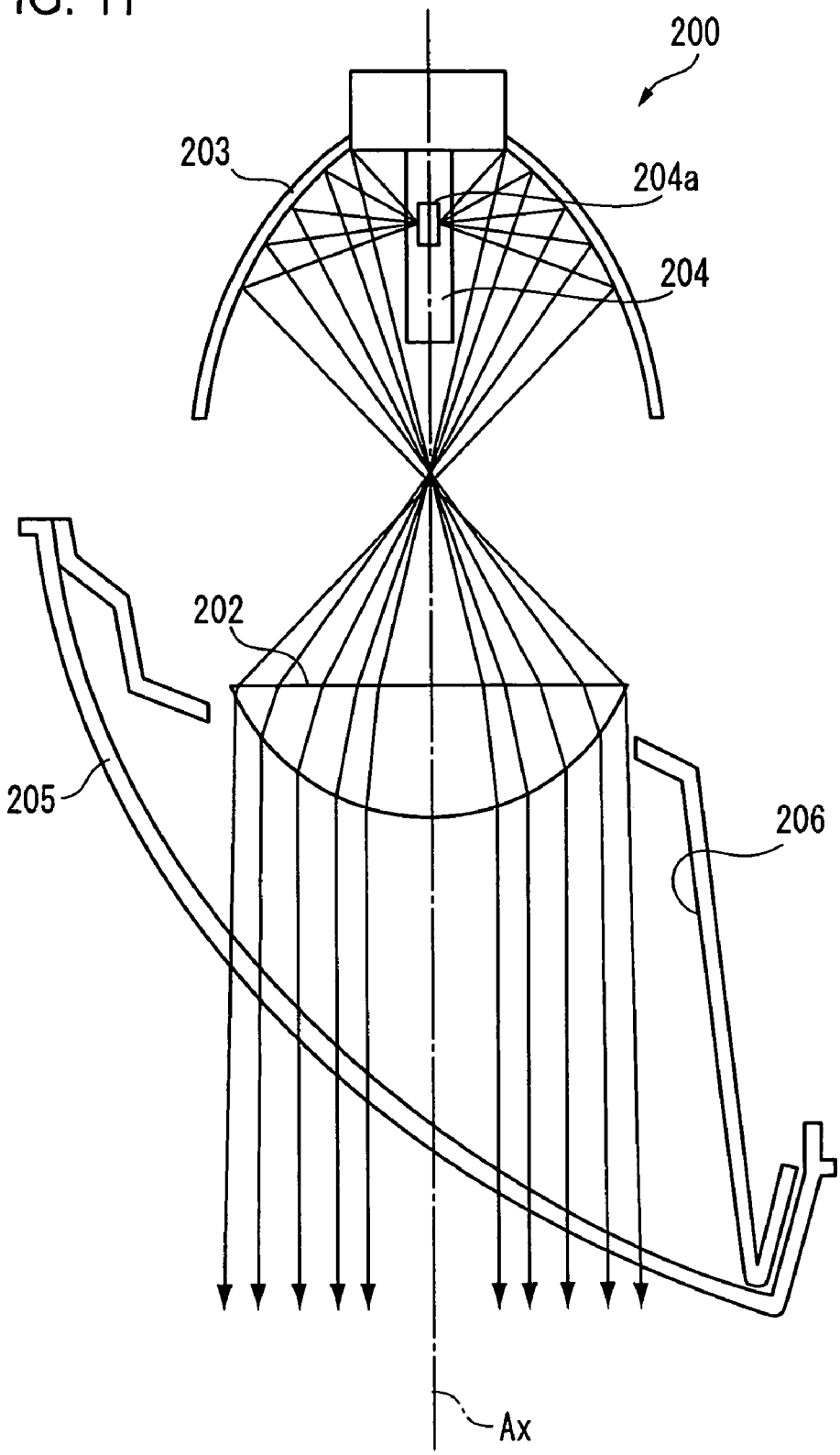
FIG. 11 is a structural drawing of a conventional projector-type headlamp.
Figure 12:
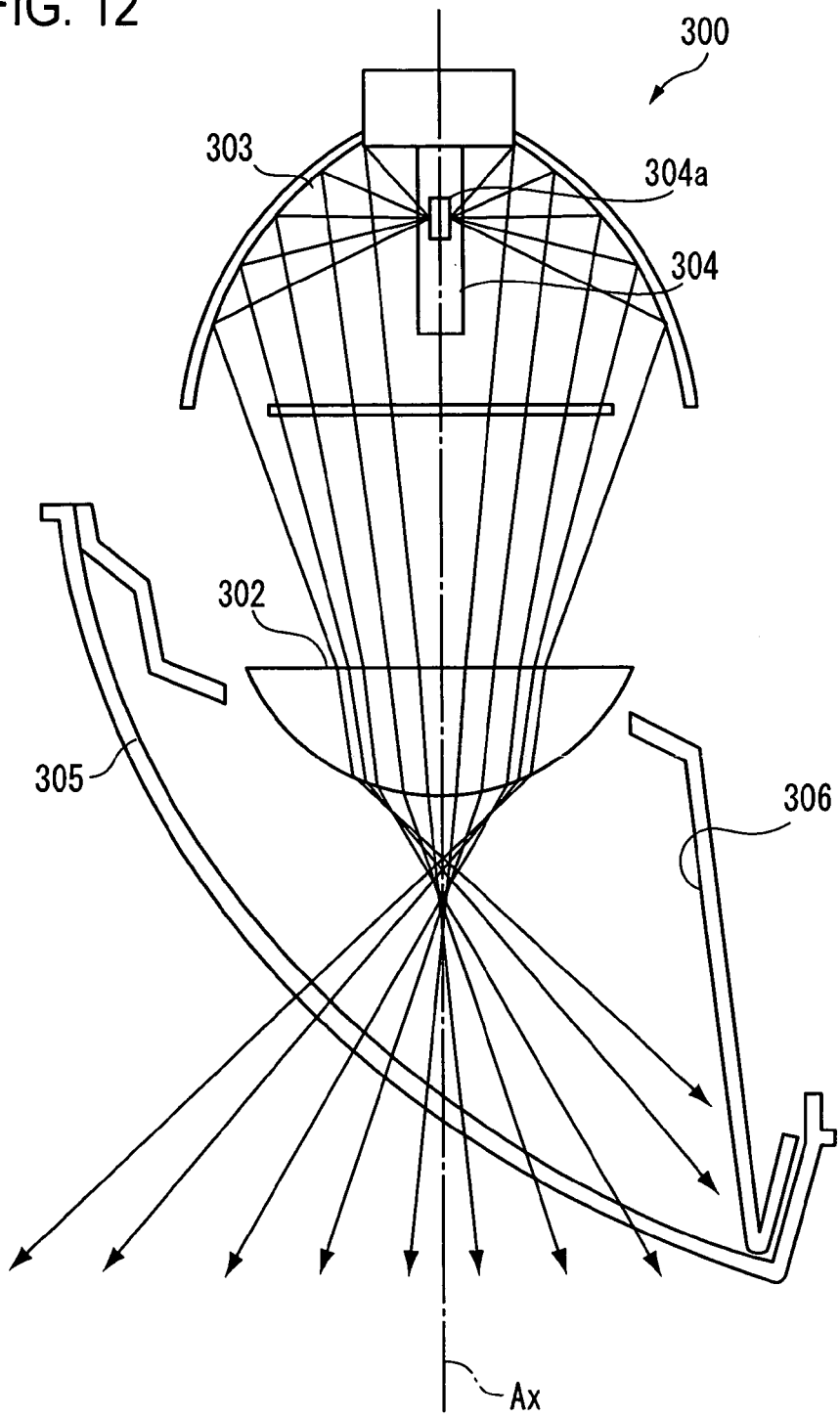
FIG. 12 is a structural drawing of another conventional projector-type headlamp.

FIG. 10 is a drawing of the light distribution simulation of the example.

In FIG. 10, where the numerical value 0 on the horizontal axis serves as a boundary, the left side corresponds to the outside of the vehicle and the right side corresponds to the inside of the vehicle. That is, the light distribution pattern from the vehicular lamp provided on the left side of the vehicle is transparently shown. In addition, the diffusion angle at the vehicular outside edge portion was 52°, and the diffusion angle at the vehicular inside edge portion was 45°.

As is clear from this drawing, in comparison to the vehicle outside from numerical values of −40° to −50° on the horizontal axis, the amount of the light distribution on the inside of the vehicle from numerical values of 40° to 50° on the horizontal axis can be limited to a small amount. That is, it is understood that because the projection lens is an asymmetrical lens, the diffusion angle range of the left and right lens portions can be suitably controlled.

Note that in the preferred embodiment described above, the vehicular lamp 100 disposed on the right front end portion of the vehicle was explained. However, an operation and effects identical to those in the preferred embodiment described above can be obtained for the vehicular lamp disposed on the left front end portion of the vehicle by using a structure identical to the embodiment described above.

What is claimed is:

1. A vehicular lamp comprising:

a projection lens;

a light source;

a reflector with a reflecting surface in which said light source acts as an approximate focal point and light from said light source is reflected toward said projection lens;

a container-shaped body; and a cover that along with said body forms a light chamber, wherein said cover has a horizontal cross-section that is slanted with respect to an imaginary line in a transverse direction of a vehicle in which the lamp is mounted, and said projection lens has a rear side focal point, said projection lens comprising a center portion and outer peripheral portions, the thickness of said projection lens decreasing from the center portion continuously to the outer peripheral portion, and said outer peripheral portions comprising a vehicular inside edge portion and a vehicular outside edge portion the vehicular inside edge portion projects more toward a front side of the vehicle than the vehicular outside edge portion;

wherein the cover curves rearward from an inner transverse side of the vehicle toward an outer transverse side of the vehicle.

2. A vehicular lamp according to claim 1, wherein in an area at a center portion of said projection lens, an incident surface and an emitting surface of the light from said light source are substantially orthogonal to the optical axis of said light source.

3. A vehicular lamp according to claim 1, further comprising an additional optical system disposed behind the vehicular inside edge portion.

4. A vehicular lamp according to claim 1, wherein said projection lens projects the light passing in proximity to the rear side focal point forward as a substantially parallel light flux.

5. A vehicular lamp according to claim 1, wherein said projection lens refracts the light incident on said vehicular outside edge portion side of said projection lens, without passing in proximity to the rear side focal point, such that the forward direction changes less than the forward direction of the light incident on said vehicular inside edge portion side.

6. A projection lens for a vehicular lamp in a vehicle, comprising:

a center portion and outer peripheral portions, wherein said projection lens has a rear side focal point, the thickness of said projection lens decreasing from said center portion continuously to said outer peripheral portions, and said outer peripheral portions comprising a vehicular inside edge portion and a vehicular outside edge portion, said vehicular inside edge portion projects more toward a front side of the vehicle than said vehicular outside edge portion;

a cover that along with a body forms a light chamber, wherein the cover curves rearward from an inner transverse side of the vehicle toward an outer transverse side of the vehicle.

7. A projection lens according to claim 6, wherein in an area at the center portion of said projection lens, a light incident surface and a light emitting surface are substantially orthogonal to the optical axis of a light source of the lamp.

8. A projection lens according to claim 6, wherein said projection lens projects light passing in proximity to the rear side focal point forward as a substantially parallel light flux.

9. A projection lens according to claim 6, wherein said projection lens refracts light incident on the vehicular outside edge portion side of said projection lens, without passing in proximity to the rear side focal point, such that the forward direction changes less than the forward direction of light incident on the vehicular inside edge portion side.

10. A vehicular lamp for a vehicle, comprising:

a light source;

a reflector for reflecting light from said light source; and a projection lens through which light reflected by said reflector passes, said projection lens having a bilaterally asymmetrical profile to change a lateral diffusion angle of light distribution from one side of an optical axis of the light source to an opposite side and thereby prevent or reduce a blockage of light wherein a thickness of said projection lens deceases from a center portion continuously to the outer peripheral portions of the lens, and wherein a vehicular inside edge portion of said projection lens extends further toward a front side of the vehicle than a vehicular outside edge portion of said projection lens.

11. A vehicular lamp according to claim 10, further comprising an additional optical system disposed behind the vehicular inside edge portion.

12. A vehicular lamp according to claim 11, wherein said additional optical system comprises a dedicated light source.

13. A vehicular lamp according to claim 11, wherein said additional optical system comprises one or more dedicated reflectors.

14. A vehicular lamp according to claim 10, wherein in an area at a center portion of said projection lens, an incident surface and an emitting surface of said light from the light source are substantially orthogonal to the optical axis.

15. A vehicular lamp according to claim 10, wherein said projection lens has a rear side focal point, and said projection lens projects the light passing in proximity to the rear side focal point forward as a substantially parallel light flux.

16. A vehicular lamp according to claim 10, wherein said projection lens refracts light incident on a vehicular outside edge portion side of said projection lens, such that the forward direction of the refracted light changes less than the forward direction of light incident on a vehicular inside edge portion side of said projection lens.

17. A vehicle, comprising:

the vehicle lamp of claim 1;

the front side of the vehicle; and the back side of the vehicle.

18. The vehicular lamp of claim 1, further comprising:

an extension provided within said chamber adjacent to the vehicular inside edge portion and adjacent to a lower edge portion of the outer peripheral portions.

* * * * *